US005413199A

United States Patent [19]

Clement

[11] Patent Number: 5,413,199

[45] Date of Patent: May 9, 1995

[54] EQUIPMENT BAG HAVING A REMOVABLE INNER MESH SACK

[75] Inventor: Leonard W. Clement, Bolton, Canada

[73] Assignee: Irwin Toy Limited, Toronto, Canada

[21] Appl. No.: 132,935

[22] Filed: Oct. 7, 1993

[51] Int. Cl.[6] ..... A45C 3/00; A45C 5/02; A45C 13/02

[52] U.S. Cl. ..... 190/108; 190/110; 190/111; 190/119; 190/903; 150/111; 150/113; 206/315.1; 383/103; 383/111; 383/117

[58] Field of Search ..... 190/108–112, 190/903, 100, 1, 107; 383/40, 117, 111, 103; 150/104, 105, 113, 111; 206/315.2

[56] References Cited

U.S. PATENT DOCUMENTS

| | | | |
|---|---|---|---|
| 1,960,396 | 5/1934 | Rosenberg | 150/105 |
| 2,258,942 | 10/1941 | White et al. | 190/111 |
| 2,437,382 | 3/1948 | Czap | 150/105 |
| 3,315,772 | 4/1967 | Katz | 190/109 X |
| 4,805,749 | 2/1989 | Gerch | 190/112 X |
| 4,830,154 | 5/1989 | Gerch et al. | 190/109 X |
| 4,887,751 | 12/1989 | Lehman | 190/903 X |
| 5,005,679 | 4/1991 | Hselle | 190/108 X |
| 5,042,664 | 8/1991 | Shyr et al. | 190/110 X |
| 5,054,589 | 10/1991 | Bomes et al. | 190/110 X |
| 5,092,682 | 3/1992 | Fenick | 383/117 X |
| 5,207,254 | 5/1993 | Fromm | 190/110 X |
| 5,288,150 | 2/1994 | Bearman | 383/117 X |

FOREIGN PATENT DOCUMENTS

| | | | |
|---|---|---|---|
| 2018895 | 12/1991 | Canada . | |
| 1729441 | 4/1992 | U.S.S.R. | 190/110 |

*Primary Examiner*—Sue A. Weaver
*Attorney, Agent, or Firm*—Jeffrey T. Imai; Arne I. Fors; D. Doak Horne

[57] ABSTRACT

An equipment bag an outer bag having a first closable opening and having a strap presenting handles for carrying the equipment bag. The outer bag has an open top and a fastener means extending thereabout. An inner mesh sack is releasably securable within the outer bag. The inner mesh sack a top panel having a second closable opening and a plurality of side panels and a bottom panel. The plurality of side panels and bottom panels are made of a mesh material. The top panel has a complementary fastener extending thereabout for joining with the fastener for closing the open top when the inner mesh sack is within the outer bag. Equipment is storable within the inner mesh sack and the inner mesh sack is removable from the outer bag for facilitating air to pass therethrough.

10 Claims, 5 Drawing Sheets

EQUIPMENT BAG HAVING A REMOVABLE INNER MESH SACK

FIELD OF INVENTION

This invention relates to an equipment bag having a removable inner mesh sack. In particular, this invention relates to a sports equipment bag having an inner mesh sack which is removable for facilitating the airing and drying of the stored equipment.

BACKGROUND OF INVENTION

Equipment bags, and in particular hockey equipment bags, come in all shapes and sizes. Traditionally, a canvas duffle bag was the common type of equipment bag. The duffle bag was manufactured large enough to store all of the hockey equipment which is normally used.

More recently, synthetic cloths have been used to manufacture equipment bags which results in a light weight bag with more than ample room to store a player
equipment, including a goal tender's equipment. The light weight feature allows the option of adding various special feature pockets for storing skates, shaving and shower kits, etc. Although a synthetic cloth is very durable, it does not breath causing moisture to be retained within the bag.

In use, the sports equipment is stored in the equipment bag and transported to the sports facility. The player will use the equipment and return it to the bag without having an opportunity to dry the equipment. The player will then transport the bag back home where the sports equipment is removed from the bag for drying. In many instances the equipment is merely dumped out and left in an unorganized condition which is unsightly. Further, equipment in this condition may not fully dry resulting in the promotion of mildew and odor. This result is not only undesirable but unsanitary.

Sports equipment bags have been proposed in Canada Patent application No. 2,018,895 which have a mesh inner cover for separating the bag into two compartments for storing wet and dry equipment. When the bag is opened the mesh cover allows air to penetrate for drying the wet equipment. However since such arrangement does not promote air flow about the wet equipment, proper drying may take an unsatisfactory length of time.

SUMMARY OF INVENTION

The disadvantages of the prior art may be overcome by providing a sports equipment bag with an inner mesh sack which is removable from the equipment bag. Once removed, the inner mesh sack may be hung allowing air to pass to fully dry the stored equipment.

According to one aspect of the invention there is provided an equipment bag comprising an outer bag having a first closable opening and having a strap presenting handles for carrying the equipment bag. The outer bag has an open top and a fastening means extending thereabout. An inner mesh sack is releasably securable within said outer bag. The inner mesh sack comprises a top panel having a second closable opening and a plurality of side panels and a bottom panel. The plurality of side panels and bottom panels are made of a mesh material. The top panel has a complementary fastener extending thereabout for joining with the fastener for closing the open top when said inner mesh sack is within said outer bag. Equipment is storable within the inner mesh sack and the inner mesh sack is removable from the outer bag for facilitating air to pass therethrough.

According to another aspect of the invention, an equipment bag is further provide with closable side compartments and closable end compartments. One end compartment comprises an end panel having a fastener extending thereabout and an inner mat. The end panel is operable for presenting the inner. mat for covering a floor surface, preventing damage to the blades of the hockey skates and presenting a clean surface standing upon after showering.

DESCRIPTION OF THE DRAWINGS

In drawings which illustrate the preferred embodiment of the invention.

DETAILED DESCRIPTION OF THE INVENTION

Figure 1:
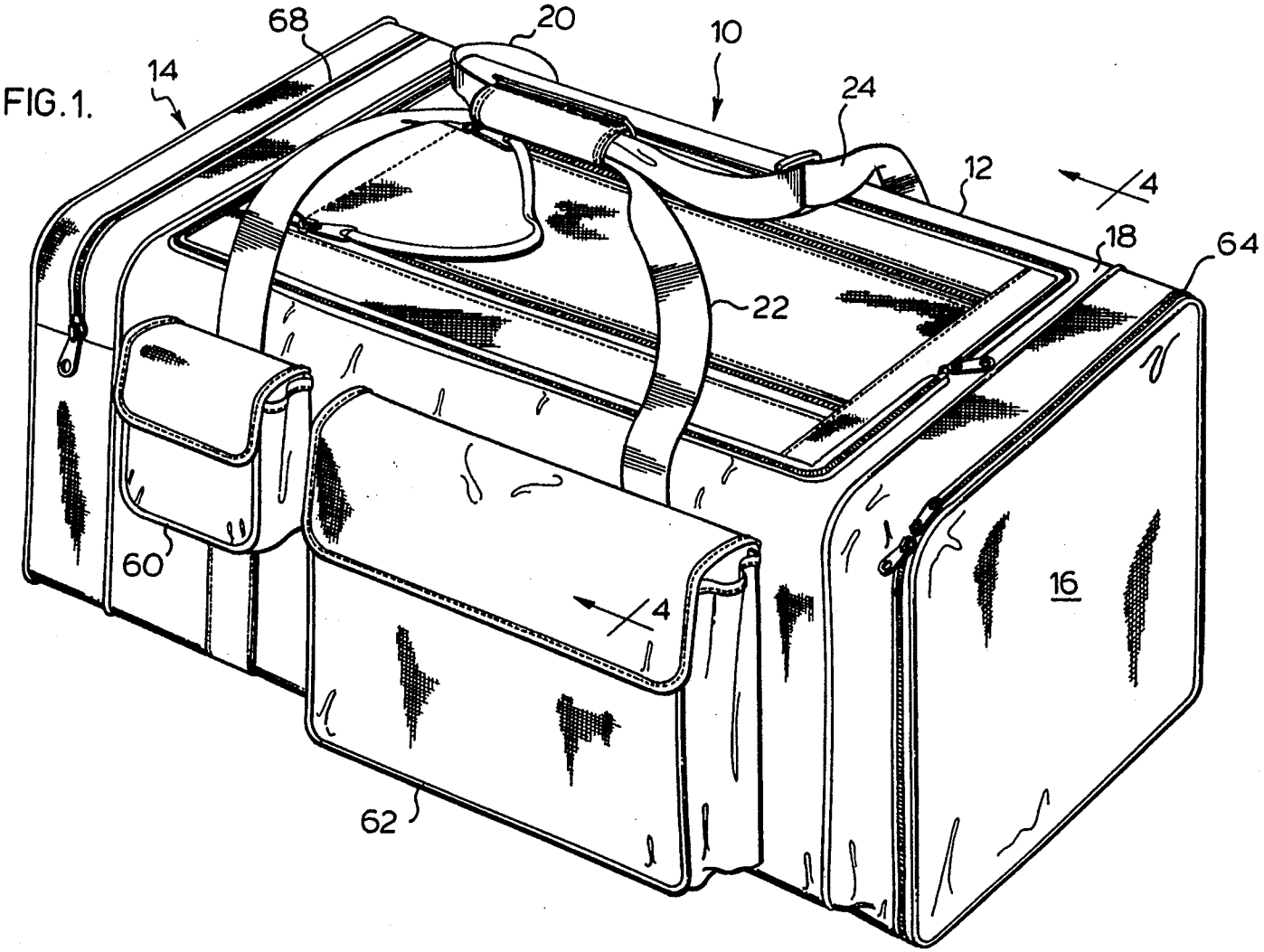
FIG. 1 is a perspective view of the sports equipment bag of the present invention.

The equipment bag of the present invention is generally illustrated in FIG. 1 as 10. The bag 10 comprises an outer shell 12 made of a flexible synthetic material, preferably a nylon material. Outer shell 12 is a closable bag having a longitudinal extent and end panels 14 and 16 and a top panel 18. Outer shell 12 has a strap 20 which are sewn thereto to extend about the outer shell to present handles and 24 adapted for carrying and supporting the bag 10.

Figure 2:
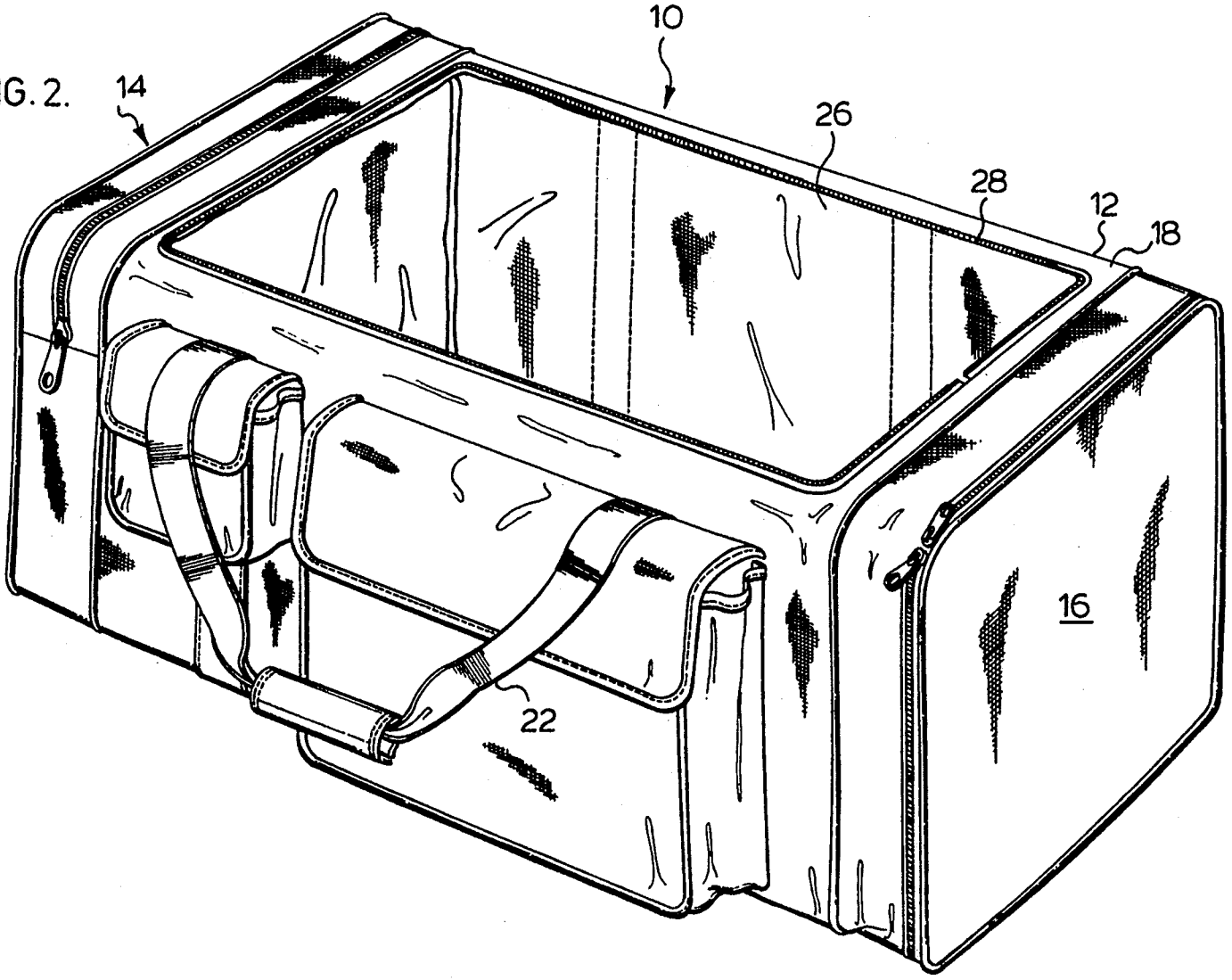
FIG. 2 is a perspective view of the sports equipment bag of the invention of FIG. 1, with the inner mesh sack removed.

Referring to FIG. 2, top panel 18 has opening 26 which permits access to the interior of outer shell 12. A fastener 28 extends about the perimeter of the opening 26. In the preferred embodiment, the fastener is a zipper. However, hook and loop fasteners could also be used.

Figure 3:
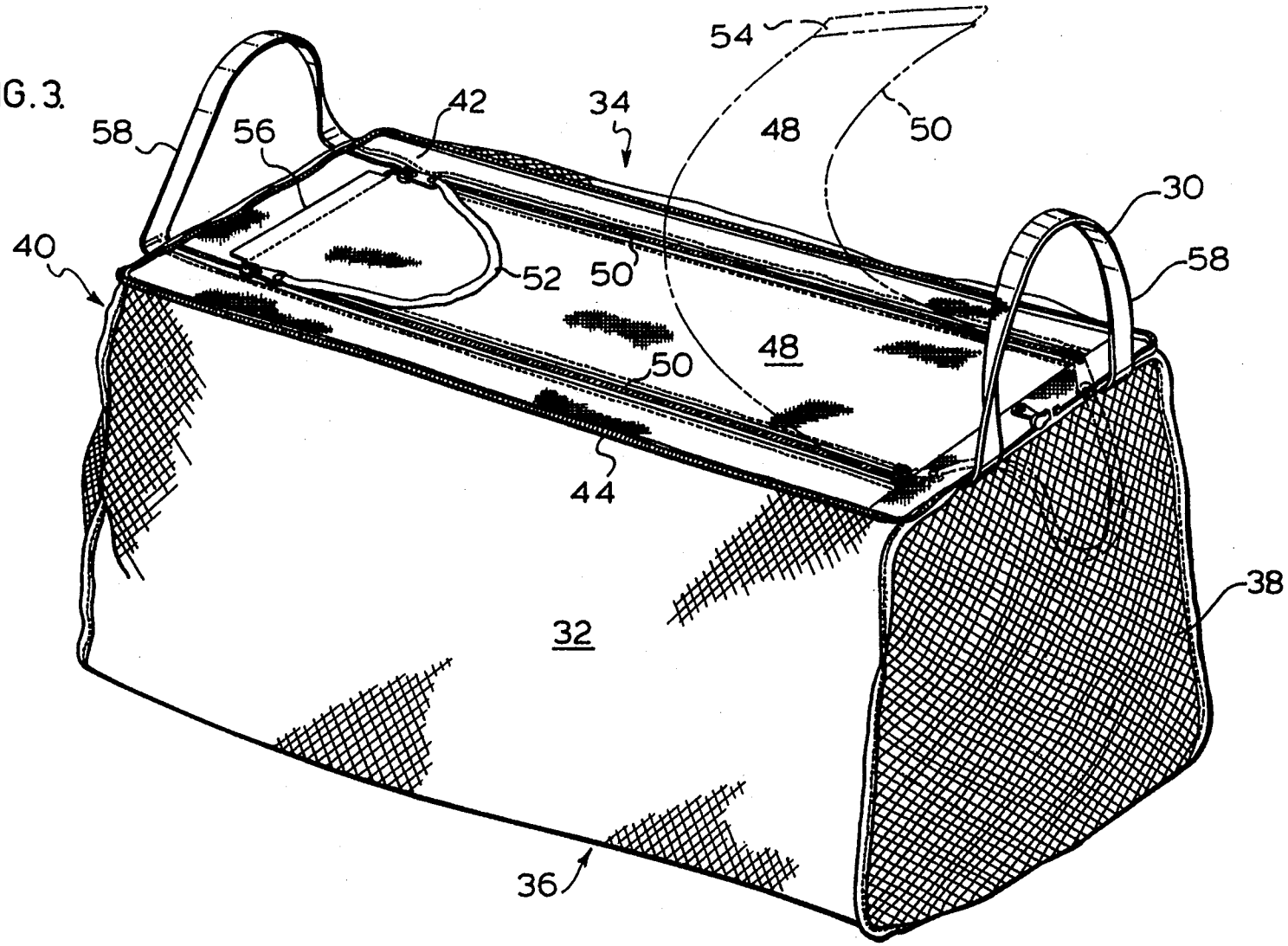
FIG. 3 is a perspective view of the inner mesh sack of the invention of FIG. 1.

Referring to FIG. 3, the inner mesh sack 30 is illustrated. Sack 30 has a plurality of mesh side panels 32 and 34, a bottom panel 36 and end panels 38 and 40. The panels of the sack 30 are made of a nylon mesh material which has openings to allow air to freely pass therethrough and small enough to store sports equipment, such as hockey, baseball, boardsailing, scuba or snorkling equipment. Sack 30 has a top panel 42 made of the same material as outer shell 12. Along the perimeter of top panel 42 is a complementary fastener 44, complementary to fastener 28 on outer shell 12.

Top panel 42 has a rectangular flap 48. Flap 48 extends substantially the full length of the top panel 42. Fastener 50 extends along each longitudinal edge of flap 48. In the preferred embodiment, the fastener is a zipper with the car of each zipper joined together by a strap 52 for simultaneously opening and closing the zippers on each edge of flap 48. The inner edge at the end of flap 48 has one side of a fastener 54 and the end of top panel 42 has a complementary fastener 56. In the preferred embodiment, fastener 54 and 56 are hook and loop fasteners, adapted to close the end of flap 48. Each end of sack 30 has a handle 58 for carrying and supporting the sack 30 and sports equipment stored therein. Handles 58 are stored within the outer shell 12 when inner mesh sack 30 is within outer shell 12.

Figure 4:
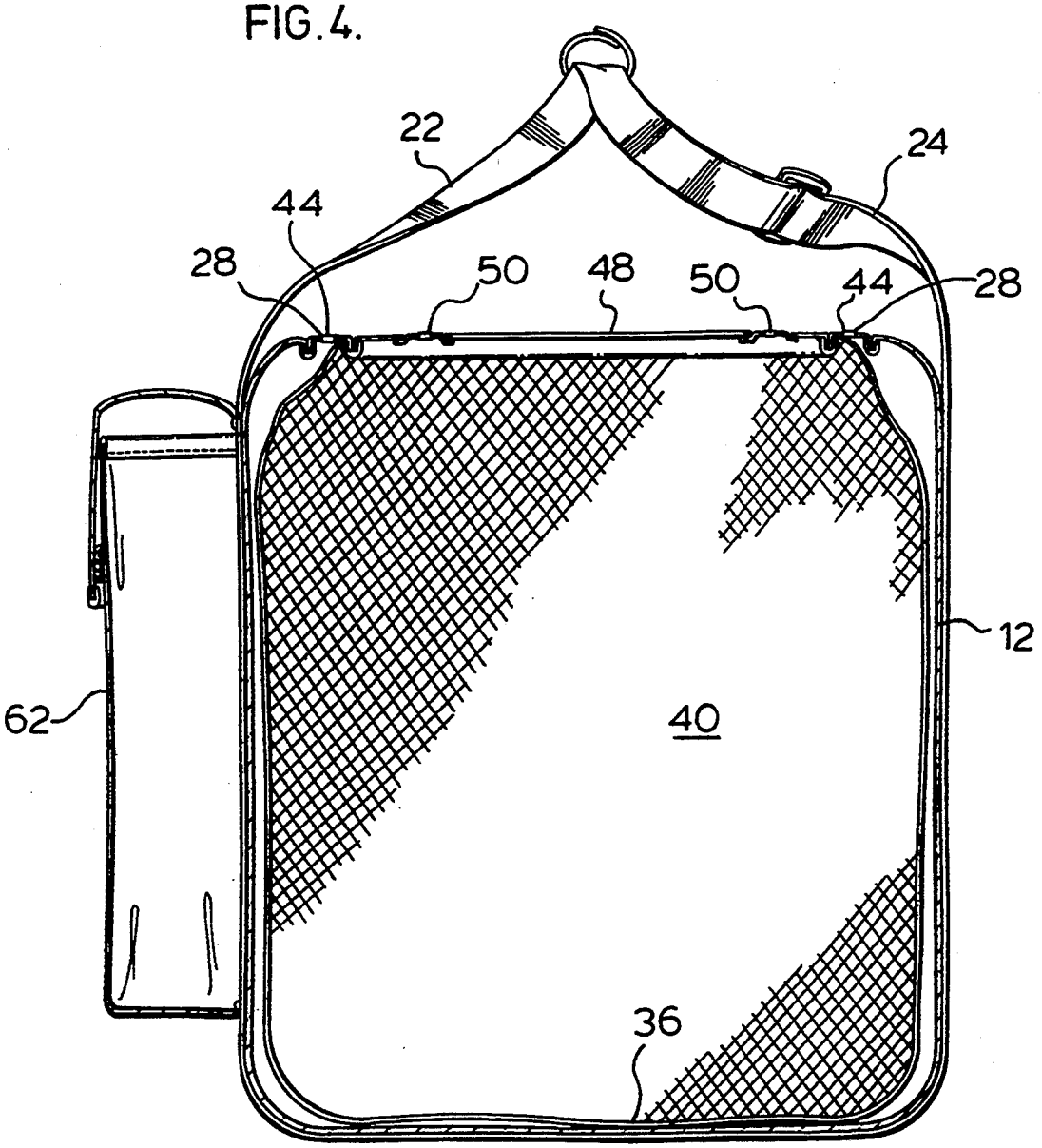
FIG. 4 is a sectional view of the invention of FIG. 1.

Sack 30 is sized to fit within outer shell 12. Outer shell 12 and inner mesh sack 30 can be any desired shape, provided inner mesh sack 30 fits within outer shell 12. In the preferred embodiment, the bag 10 has a generally parallelepiped shape having a square cross-sectional shape as illustrated in FIG. 4. Tubular shapes are also contemplated.

Optionally, the bag 10 is provided with a plurality of additional pockets or compartments for storing various other equipment. For instance, pocket 60 mounted on the side of outer shell 12 could be used to store cans of drinks. Pocket 62 mounted on the side of the bag 10 could be used to store hockey skates. Each end of outer shell 12 could be provided with additional compartments.

Figure 5:
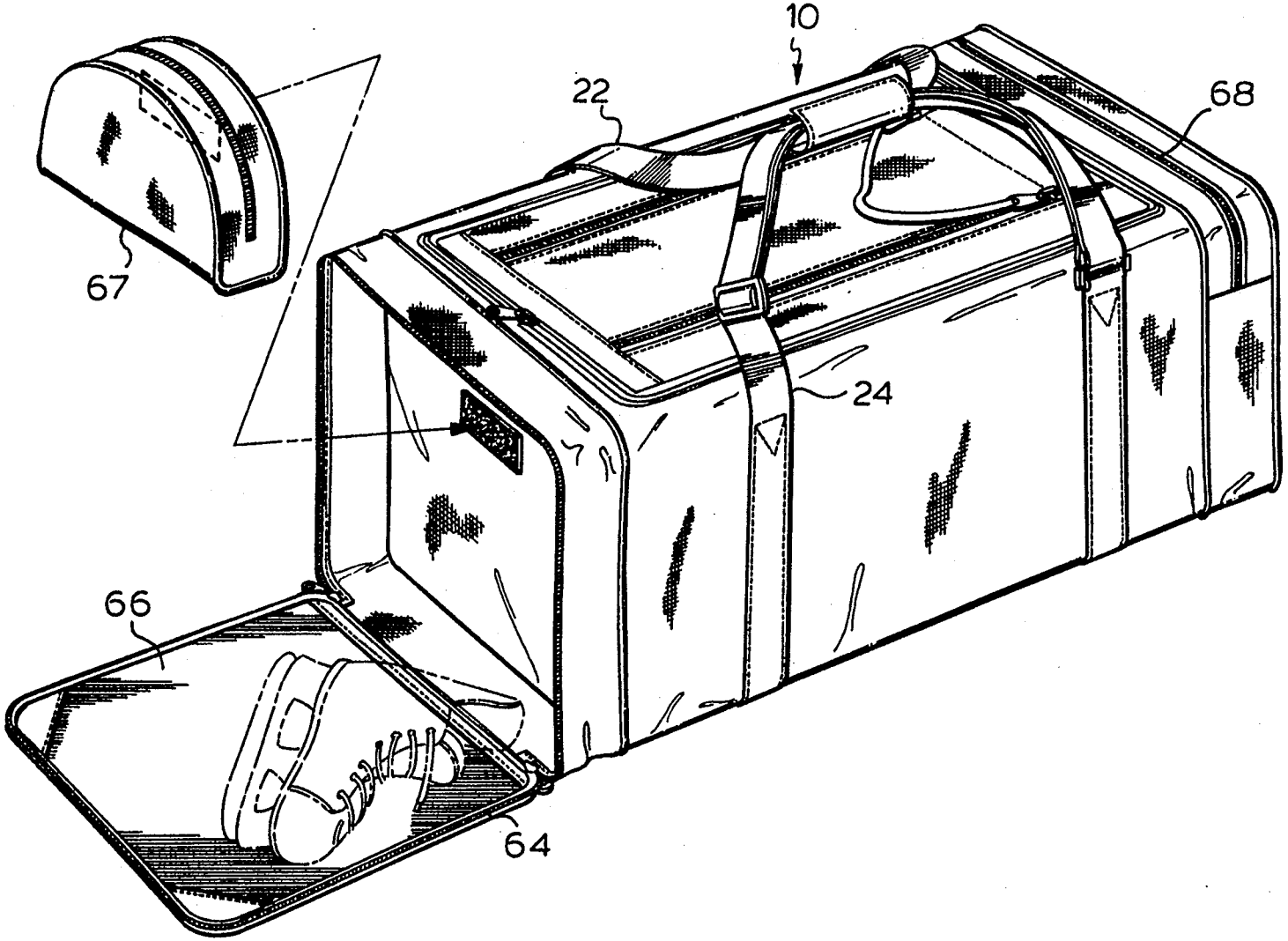
FIG. 5 is a perspective view of the opposite side of the sports equipment bag of FIG. 1, illustrating the mat of one end compartment in an open condition.

Referring to FIG. 5, end panel 16 optionally has a zipper 64 extending about the perimeter. Unzipping the zipper 64 allows end panel to fold downwardly presenting a mat or closed cell pad 66 to prevent damage to skates during lacing and a clean surface for standing upon after showering. A shave kit 67 which is removably fastened to the inside of the compartment could also be stored in this compartment. End panel 14 has a zipper 68 presenting a compartment which could be used to store additional toiletries for showering.

Handles 22 and 24 optionally have a buckle 72 for adjusting the length of the handle 24 and a handle flap 70 having a hook and loop fastener for releasably retaining the handles 22 and 24 together for improving the carriability of the bag 10.

In use, the inner mesh sack is fitted within the outer shell 12. Complementary fasteners 28 and 44 are joined and closed securing sack 30 within outer shell 12. Fasteners 54 and 56 are released and fastener 50 is withdrawn opening flap 48. The sports equipment is placed within the bag 10 within inner mesh sack 30. Fastener 50 is closed, fastener 54 is presented to fastener 56 closing flap 48. The bag 10 is transported to the sports facility and used in the conventional manner. The used sport equipment is returned to the bag 10.

Once the user has returned home, fastener 28 and 44 is released, separating the inner mesh sack 30 from the outer shell. The user grabs the handles 58 and lifts the inner mesh sack 30 from the outer shell 12. In this condition, the user can hang the inner mesh sack 30 from a hook or other convenient location allowing air to pass through the inner mesh sack 30 for improved drying. Alternatively, the inner mesh sack 30 could be merely lifted out of the outer shell 12 and placed on the floor. All of the stored equipment is neatly stored within the inner mesh sack 30. Once the equipment has dried, the inner mesh sack 30 can be replaced within the outer shell 12 and the fasteners 28 and 44 re-fastened, ready for transportation.

It is now apparent to a person skilled in the art that the present invention could be dimensioned to fit different classes of users and equipment. However, since many other modifications and purposes of this invention become readily apparent to those skilled in the art upon perusal of the foregoing description, it is to be understood that certain changes in style, size and components may be effective without a departure from the spirit of the invention and within the scope of the appended claims.

I claim:

1. An equipment bag comprising an outer bag having a first closable opening and having a strap presenting handles for carrying said equipment bag, an inner mesh sack releasably securable within said outer bag, said inner mesh sack having a second closable opening, means for closing said second closable opening and handle means for carrying said inner mesh sack when said inner mesh sack is separated from said outer bag, said first closable opening comprises an opening in said outer bag and said opening having a fastening means extending thereabout and said inner mesh sack has a top panel made of a synthetic cloth and a plurality of side panels and a bottom panel, at least two of said plurality of side panels and bottom panel made of a mesh material for facilitating air to pass therethrough, said top panel having a complementary fastening means extending thereabout whereby when said inner mesh sack is within said outer bag, said fastening means and complementary fastening means close said opening and equipment is storable within the inner mesh sack and the inner mesh sack is removable from the outer bag for drying said equipment and said inner mesh sack is securable within said outer bag for transportation.

2. An equipment bag as claimed in claim 1 wherein said equipment bag further comprises a closable side compartment.

3. An equipment bag as claimed in claim 2 wherein said equipment bag further comprises a closable end compartment.

4. An equipment bag as claimed in claim 2 wherein said equipment bag comprises two closable end compartments, one of said end compartment comprises an end panel having a retaining means extending thereabout and having an inner mat, said end panel openable for presenting said inner mat for covering a floor surface.

5. An equipment bag as claimed in claim 4 wherein one of said compartments includes a shave kit.

6. An equipment bag comprising an outer bag having a first closable opening comprising an open top and a fastening means extending thereabout and said outer bag having a strap presenting handles for carrying said equipment bag, an inner mesh sack releasably securable within said outer bag, said inner mesh sack comprises a top panel having a second closable opening and means for closing said second closable opening and a plurality of side panels and a bottom panel, said plurality of side panels and bottom panels made of a mesh material, said top panel having complementary fastening means extending thereabout for joining with said fastening means for closing said open top when said inner mesh sack is within said outer bag, whereby equipment is storable within the inner mesh sack and the inner mesh sack is removable from the outer bag for facilitating air to pass therethrough for drying said equipment and said inner mesh sack is securable within said outer bag for transportation.

7. An equipment bag as claimed in claim 6 wherein said equipment bag further comprises a closable side compartment.

8. An equipment bag as claimed in claim 7 wherein said equipment bag further comprises a closable end compartment.

9. An equipment bag as claimed in claim 7 wherein said equipment bag comprises two closable end compartments, one of said end compartment comprises an end panel having a retaining means extending thereabout and having an inner mat, said end panel openable for presenting said inner mat for covering a floor surface.

10. An equipment bag as claimed in claim 9 wherein one of said compartments includes a shave kit.

* * * * *